United States Patent [19]

von Reis et al.

[11] Patent Number: 4,765,499

[45] Date of Patent: Aug. 23, 1988

[54] FILTER CAP

[76] Inventors: Charles von Reis, 1923 Dunmore Rd., Ann Arbor, Mich. 48103; Karlis Vizulis, 202-1/2 W. Henry, Saline, Mich. 48176

[21] Appl. No.: 139,015

[22] Filed: Dec. 29, 1987

[51] Int. Cl.[4] ..... B65D 51/16

[52] U.S. Cl. ..... 215/261; 220/371; 220/256

[58] Field of Search ..... 220/371, 372, 373, 256; 215/261

[56] References Cited

U.S. PATENT DOCUMENTS 3,448,882 6/1969 Roy ..... 215/261

3,951,293 4/1976 Schulz ..... 215/261

*Primary Examiner*—Donald F. Norton

*Attorney, Agent, or Firm*—Reising, Ethington, Barnard Perry & Milton

[57] ABSTRACT

A venting closure (10) for containers (12) having a pour opening (14) defined by a circumferential rim (16) includes a top wall (20) having inner (22) and outer (24) surfaces. A side skirt (26) extends from the top wall (20) about the inner surface (22). A liner (28) is mounted adjacent the inner surface (22) for perfecting a seal between the top wall (20) and the circumferential rim (16) when the closure (10) is secured upon the rim (16) and over the opening (14). The liner (28) includes a gas impermeable non-hydrophobic portion (30) at least about the periphery of the liner (28) and an integral gas permeable hydrophobic portion (32) offset therefrom.

12 Claims, 1 Drawing Sheet

FILTER CAP

TECHNICAL FIELD

The present invention relates to venting type closure caps for containers. More specifically, the present invention relates to an effective means for venting excessive internal pressure while ensuring satisfactory hermetic closing about the container opening.

BACKGROUND ART

Containers are used for storing various types of volitile liquids, for example, chlorine. Packaging conditions, changes in ambient temperature, as well as other factors can cause the creation of gas fumes within the container and an increase of internal pressure. It is necessary to vent the container to avoid the explosion or implosion caused by the increased internal pressure or vacuum. At the same time, it is necessary to perfect sufficient sealing about the container opening to insure safety from undesirable leakage and spilling from the container.

Various can and container top venting caps have been derived. For example, the U.S. Pat. No. 30,585 to Paddock, patented Nov. 6, 1860, discloses a can including a lid having a valve guarded aperture communicating outwardly with an exhaust or vapor chamber which in turn communicates with a sealing cap. The U.S. Pat. No. 1,467,706 to Collins, issued Sept. 11, 1923, discloses a can top vent including a cap having a hole through its top wall located centrally thereof covered by a plate fixed to the outer surface of the top wall. The place has a convolute corrugation formed therein, the outer end of which terminates at the edge of the plate which is preferably a disk shape while the other end terminates substantially in the center of the plate. The corrugation produces a convolute air channel with an inlet at its outer end which communicates with the atmosphere while the inner end of the corrugation overlies the hole in the cap so that the inner terminus of the channel communicates with the hole to complete the communication between the interior of the container and the atmosphere.

The U.S. Pat. No. 4,545,498 to Schmid, issued Oct. 8, 1985, discloses a container with a lid for effervescent products. The lid has openings for the escape of gas. A layer, covering the opening is affixed to the surface of the lid. A passage leads to the exterior and is connected with the openings disposed between the layer and the lid.

A problem exists with direct openings between the interior of the container, through a lid and passageway, to an exhaust. Tilting or inadvertent shaking of the container can results in spilling of the contents through the opening and passageway. It has been found that hydrophobic membranes can be utilized which allow the passage of various gases for decreasing the interior pressure of the container while perfecting a seal for containing a liquid. For example, the U.S. Pat. No. 3,951,293 to Schulz, issued Apr. 20, 1976, discloses a gas permeable liquid closure for containers of liquids or solids which emit or absorb gas. The closure includes a film of unsintered tetrafluoroethylene. The film is supported across an opening of the container by a perforated cap or a perforated sealing diaphragm which is disposed on either one or both sides of the film. Problems have arisen with the use of hydrophobic membrane layers in sealing caps. The hydrophobic membranes are most often quite fragil and are unable to perfect a seal between a cap and the lip of an opening of a container. The membrane can be damaged during closure of the cap so as to not perfect a hermetic seal.

Additionally, most container caps are shipped in bulk packages. During shipping, the caps take a random position within a bulk package. Depending upon the ratio of the size of the skirt of the cap to the diameter of the base of the cap, there remains the possibility that a corner of one cap can enter the skirt of another cap so as to contact and damage the membrane.

The present invention provides a solution to the aforementioned problem by providing a protective filter cap which can effectively perfect a hermetic seal yet is able to vent internal pressures, and additionally avoids damage during shipping.

SUMMARY OF THE INVENTION

In accordance with the present invention, there is provided a venting closure for containers having a pour opening defined by a circumferential rim, the closure including a top wall having an inner and outer surface and a side skirt extending from the top wall about the inner surface thereof. Liner means is mounted adjacent the inner surface for perfecting a seal between the top wall of the venting closure and the circumferential rim of the container when the closure is secured upon the rim and over the opening of the container. The invention is characterized by the liner means including a gas impermeable non-hydrophobic portion at least about the periphery of the liner means and an integral gas permeable hydrophobic portion offset therefrom.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
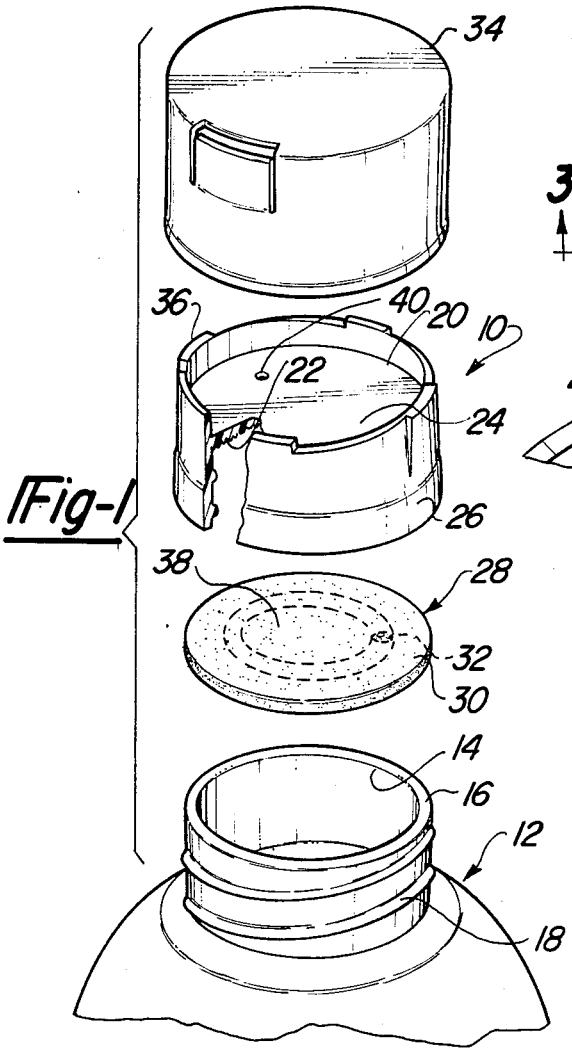
FIG. 1 is an exploded perspective view of the present invention.

A venting closure constructed in accordance with the present invention is generally shown at 10 in the drawings. Primed numbers are used to indicate like structure between the several embodiments.

Figure 2:
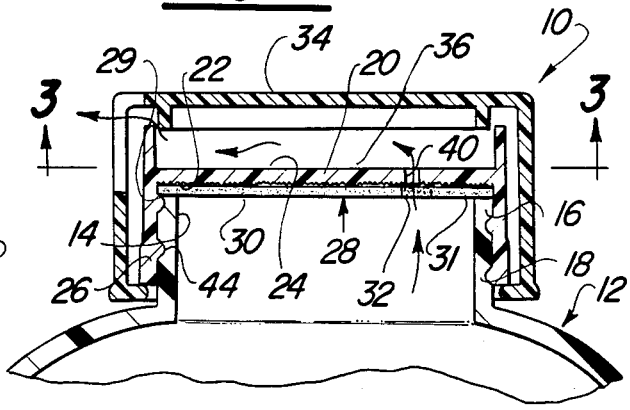
FIG. 2 is a cross sectional view of the present invention secured upon a circumferential rim of a container.
Figure 3:
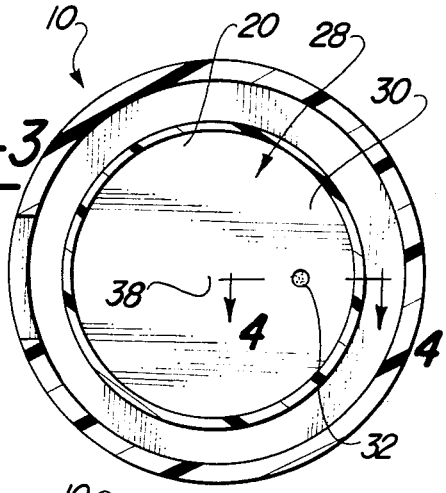
FIG. 3 is a plan view taken substantially along lines 3—3 of FIG. 2.
Figure 4:
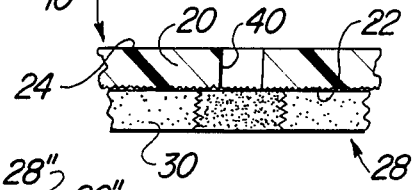
FIG. 4 is a fragmentary cross sectional view taken substantially along lines 4—4 of FIG. 3.

The venting closure of the present invention is for a container generally indicated at 12 of the type having a pour opening 14 defined by a circumferential rim 16. As shown in FIGS. 1 and 2, the rim 16 includes a helical thread 18 thereabout. The container shown in FIGS. 1 and 2 is a bottle having a neck portion defining the circumferential rim 16. A container suitable for use with the present invention may take other forms of existing containers having circumferential rims defining openings therein.

Generally, the closure 10 includes a top wall 20 having an inner surface 22 and outer surface 24. A side skirt 26 extends from the top wall 20 about the inner surface 22. A liner, generally indicated at 28 is mounted adjacent the inner surface 22 for perfecting a seal between the top wall 20 of the closure 10 and the circumferential rim 16 of the container 12 when the closure 10 is secured upon the rim 16 and over the opening 14.

The liner 28 includes a gas impermeable non-hydrophobic portion 30 at least about the periphery of the liner 28 and an integral gas permeable hydrophobic portion 32 offset therefrom. The nonhydrophobic portion 30 at least forms a radially peripheral rim of the liner 28 for being engaged between the top wall 20 and rim 16. Thusly, the present invention provides a gas permeable liner which vents gases from a container and thereby relieves pressure within the container wherein the seal is perfected between the cover member 20, the circumferential rim 16 of the container 12 and the more durable gas impermeable non-hydrophobic portion 30 of the liner 28. The gas permeable hydrophobic 32 is offset from the hermetic sealing portion of the liner 28 thereby protecting it from damage. The hydrophobic portion 32 is also exposed to the inner compartment of the container 12 for performing the venting function. The hydrophobic portion 32 is integral with the remaining non-hydrophobic portion 30 of the liner 28 thereby providing a simple one layer membrane construction.

The hydrophobic portion 32 can be made integral with the non-hydrophobic portion 30 through various means, such as gluing, ultrasonic bonding, or various other types of adhesion between the hydrophobic portion 32 and the non-hydrophobic portion 30. Most simply, an opening is made through a non-hydrophobic liner and a hydrophobic membrane is adhered thereto about the opening, thereby closing off the opening through the non-hydrophobic liner.

The closure structure 10 shown in the Figures is a safety cap type closure including an outer cover portion 34 and an inner cover portion 36, the inner cover portion 36 including the top wall 20 and side skirt 26. Alternatively, the instant invention can comprise a single cover member or various other types of cover members of either 1, 2 or multiple part constructions.

The liner 28 includes a center portion 38. The hydrophobic portion 32 is offset from the center portion 38. In this manner, the hydrophobic portion 32 is inaccessible to the various corners of other container caps during shipping. Since the hydrophobic portion 32 is generally of the type which is susceptible to damage due to impact with these corners of other container caps during shipping, the offset placement of the hydrophobic portion 32 removes the hydrophobic portion 32 from the areas of impact.

Figure 8:
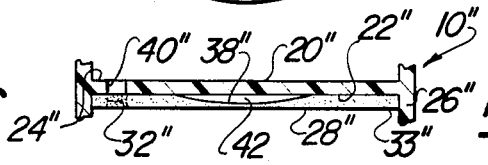
FIG. 8 is a cross sectional view taken substantially along lines 8—8 of FIG. 7.

The top portion 20 of the cover 10 includes venting means for venting gases therethrough. As shown in the FIGS., the venting means comprises an opening 40 extending through the top portion 20. As shown in the embodiment labeled 10" in FIG. 8, the liner 28" can be secured to the top portion 20" by the application of a glue or other adhesive 42. If the liner 28" is fixedly secured to the top portion 20" and the opening 40" is aligned directly adjacent to the hydrophobic membrane 32", venting can occur directly through the hydrophobic membrane 32" to the opening 40". However, if either the liner 28" is fixedly secured to the top portion 20" and the hydrophobic membrane 32" is not aligned with the opening 40" or, as shown in FIGS. 1–7, the liner 28,28' is force fit within the inner aspects of the thread 44 of the skirt Then channel means are provided in the top portion 20 extending between the hydrophobic portion 32,32' and the opening 40,40' for conducting fluid communication therebetween.

More specifically, and referring to the embodiment shown in FIGS. 1–4, the side skirt 26 includes an annular groove 29 which can be defined by the extent of the inner thread 44 on the skirt 26 at its inner most extent. The liner 28 includes a peripheral edge 31 force fit into the groove 29. The channel means includes random irregularities in the inner surface 22 of the top wall 20 defining an infinite number of channels between the hydrophobic portion 32 and the opening 40. The irregular surface can be in the form of a charmelled surface or other type of textured surface providing random irregularities in the surface 22.

Figure 5:
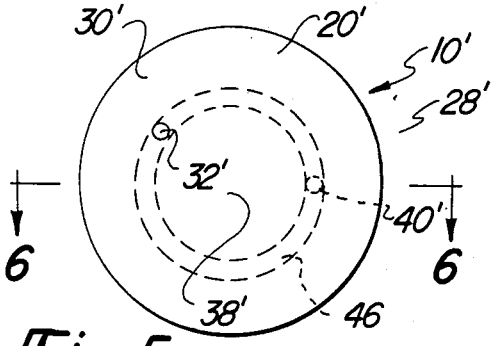
FIG. 5 is a plan view of a second embodiment of the present invention.
Figure 7:
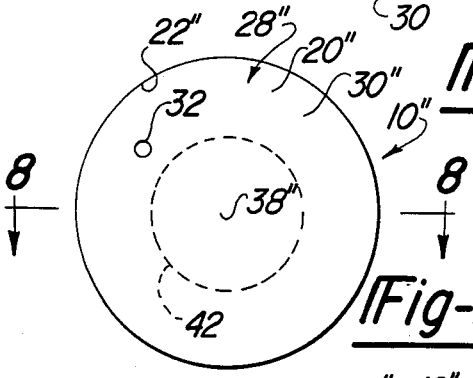
FIG. 7 is a plan view of a third embodiment of the present invention.
Figure 6:
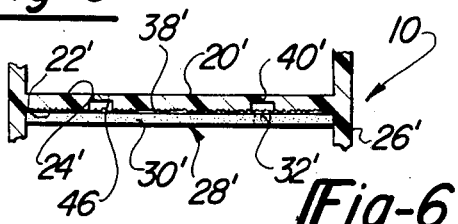
FIG. 6 is cross sectional view taken substantially along lines 6—6 of FIG. 5.

An alternative embodiment of the channel means is shown in FIGS. 5 and 6 wherein the channel means includes an annular groove 46 extending into the inner surface 22 of the top wall 20. The groove 46 is spaced a predetermined distance from the center portion 38' of the top wall 20' and defines a radial length. The hydrophobic portion 32' is spaced from the center portion 38' the same predetermined radial length from the center of the liner 28 such that the hydrophobic membrane 32' is always aligned adjacent to the groove 46. The opening 40' extends through the groove 46 so that there is continually fluid communication between the hydrophobic membrane 32' and opening 40'. Of course, the venting means can take other forms, such as a projection spacing the liner 28 from the inner surface 22 of the top wall 20.

The hydrophobic portion can consist essentially of a polytetrafluoroethylene membrane. Other types of gas permeable hydrophobic membranes can be utilized. The non-hydrophobic portion 30 of the liner 28 can be made from various types of fibrous or nonfibrous materials. Preferably, a closed cellfoam is used, but other type of materials can be used.

In operation, the skirt portion 26 of the inner cap member 36 is threadably connected to the thread 18 on the circumferential rim 16 of the container 12. A peripheral edge 31 of the liner 28 perfects a hermetic seal between the circumferential rim 16 and top wall 20, the peripheral edge 31 consisting essentially of the non-hydrophobic material of the non-hydrophobic portion 30. Gas pressure is either vented through the hydrophobic membrane 32 directly through the opening 40 or is vented through the channel defined by the irregular surface of the top wall 20 or through the channel 46 in the top wall 20'.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A venting closure (10) for containers (12) having a pour opening (14) defined by a circumferential rim (16), said closure (10) comprising: a top wall (20) having an inner (22) and an outer (24) surface, a side skirt (26) extending from said top wall (20) about said inner surface (22) and liner means (28) mounted adjacent said inner surface (22) for perfecting a seal between said top wall (20) and the circumferential rim (16) when said closure (10) is secured upon the rim (16) and over the opening (14), characterized by said liner means (28) including a gas impermeable non-hydrophobic portion (30) at least about the radial periphery of said liner means (28) and an integral gas permeable hydrophobic portion (32) offset therefrom.

2. A closure as set forth in claim 1 further characterized by said liner means (28) including a center portion (38), said hydrophobic portion (32) being offset from said center portion (38).

3. A closure as set forth in claim 2 further characterized by said liner means (28) comprising a non-hydrophobic member (30) including an opening extending therethrough, said hydrophobic portion (32) including a hydrophobic member bonded to said non-hydrophobic membrane (30) within said opening perfecting a complete closure of said opening and defining an integral single layer membrane (28).

4. A closure as set forth in claim 3 further characterized by said top portion (20) including venting means for venting gases therethrough, said top portion (20) including channel means (32,32') extending between said hydrophobic portion (32,32') and said venting means (40,40') for conducting fluid communication therebetween.

5. A closure as set forth in claim 4 further characterized by said channel means including random irregularities in said inner surface (22) of said top wall (20) defining an infinite number of channels between said hydrophobic portion (932) and venting means (40).

6. A closure as set forth in claim 4 further characterized by said channel means including an annular groove (46) extending into said inner surface (22) of said top wall (20), said groove (46) being spaced a predetermined distance from said center portion (38') of said top wall (20) and defining a radial length, said hydrophobic portion (32') being spaced from said center portion (38') a distance equal to said radial length, said venting means (40') being located through a portion of said groove (46).

7. A closure as set forth in claim 5 or 6 wherein said venting means includes an opening (40) extending through said top wall (20).

8. A closure as set forth in claim 4 further characterized by including connecting means for connecting said linear means (24) adjacent to said top wall (20).

9. A closure as set forth in claim 8 further characterized by said connecting means including an annular groove (29) in said skirt (26), said liner means (28) including a peripheral edge (31) force fit in said groove (24).

10. A closure as set forth in claim 8 further characterized by said connecting means including an adhesive (42) disposed between said nonhydrophobic portion (30) and said inner surface (22) of said top wall (20).

11. A closure as set forth in claim 10 further characterized by said hydrophobic portion (32) consisting essentially of a polytetrafluoroethylene membrane.

12. A closure as set forth in claim 1 further characterized by said closure (10) including an outer cover member (34) and an inner cap member (36), said cap member (36) including said top wall (20), side skirt (26), and said liner means (28).

* * * * *